US006666256B2

(12) United States Patent
Fukai et al.

(10) Patent No.: US 6,666,256 B2
(45) Date of Patent: Dec. 23, 2003

(54) METHOD OF CASTING A PRODUCT

(75) Inventors: Shigeki Fukai, Saitama-ken (JP); Shunzo Aoyama, Saitaka-ken (JP)

(73) Assignee: Ahresty Corporation, Tokyo (JP)

( * ) Notice: Subject to any disclaimer, the term of this patent is extended or adjusted under 35 U.S.C. 154(b) by 0 days.

(21) Appl. No.: 09/794,358

(22) Filed: Feb. 28, 2001

(65) Prior Publication Data

US 2001/0013401 A1 Aug. 16, 2001

Related U.S. Application Data

(63) Continuation-in-part of application No. 08/728,047, filed on Oct. 9, 1996, now abandoned.

(30) Foreign Application Priority Data

Oct. 9, 1995 (JP) ..... 7-289355
Jun. 28, 1996 (JP) ..... 8-169842

(51) Int. Cl.[7] ..... B22D 19/00
(52) U.S. Cl. ..... 164/100; 164/98; 164/97
(58) Field of Search ..... 164/100, 98, 97

(56) References Cited

U.S. PATENT DOCUMENTS 5,537,969 A * 7/1996 Hata et al. ..... 123/193.2

* cited by examiner

*Primary Examiner*—Tom Dunn
*Assistant Examiner*—I.-H. Lin
(74) *Attorney, Agent, or Firm*—Dykema Gossett PLLC

(57) ABSTRACT

An intermediate material is formed by coating at least a half of the surface of a function selecting material having at least one of physical property values that are different from those of a casting metal material forming a cast product with a coating metal material and the casting metal material is cast together with the intermediate material to form a composite body in casting the product.

18 Claims, 4 Drawing Sheets

(a)

(a)

(b)

(c)

EXAMPLE 1 x 50

EXAMPLE 3 x 50

EXAMPLE 4 x 50

EXAMPLE 5 x 50

METHOD OF CASTING A PRODUCT

CROSS-REFERENCE TO RELATED APPLICATIONS

This is a continuation-in-part of application Ser. No. 08/728,047, filed Oct. 9, 1996 and now abandoned.

BACKGROUND OF THE INVENTION

Field of the Invention and Related Art Statement

The present invention relates to a method of casting a product.

It is often not necessary for the whole of a cast product to have a function that is required for only a part of the product. For example, an abrasive face of the cylinder portion in an engine block requires high wear resistance; however, the wear resistance is not required for the other portions. Therefore, it is sufficient in the cast product that only the necessary portion or the surface has the required function.

In such a case it has been conventionally proposed as a method of adding the wear resistance to a portion of a cast product, for example, to set a preform comprising alumina, silicon nitride, silicon carbide or whiskers of these in a fiber form in a mold cavity and to force a molten metal into the mould cavity and into gaps among respective fibers. However, according to this method much restriction is imposed on the shape of the product, manufacturing steps are prolonged and the machinability of the product as cast is poor, giving rise to a disadvantage of very high production cost.

Hence, the applicants have previously proposed a method of providing a wear resistant layer on the surface of a cast product by directly casting metal together with wear resistant fine particles as disclosed in Japanese Unexamined Patent Publication No. Hei 7-124739. However, according to this conventional method, when the size of the wear resistant fine particles is increased, the machinability is deteriorated. On the other hand, when the size of the wear resistant fine particles is decreased, the thickness of the wear resistant layer becomes very thin. Moreover, when the metal is cast together with the wear resistant fine particles, there is a risk that the function of the cast product will not be achieved since a binder holding the wear resistant fine particles remains in the cast product and it is difficult to increase the thickness of the wear resistant layer.

In Patent Abstracts of Japan vol. 095, No 008.29 September 1995 and JP 07 124739A, it is set forth that a collapsible core can be provided with a coating before a casting step, and the coating remains with the casting after the core is collapsed and removed, but this publication does not disclose the nature of the coating, and so it does not deal with the objective of the present invention.

Also, in U.S. Pat. No. 3,945,423 (E1) the inventor is concerned with the formation of a wear resistant shell by electro-deposition of a layer on the surface of a core, so that at the end of forming of the layer, the electric current is increased, which has the effect of making the deposited layer surface rough. The core with the rough surface is placed in a bath of coating metal material (eg aluminium) which binds mechanically by virtue of the rough surface of the deposited layer, and then the core with the layer and aluminium coating is placed in a mould for the formation of the cast product. Eventually, the core is removed, and the cast product has a hard surface characteristic. The disclosure is not concerned with coating wear resistant particles with aluminium or the like, but rather that a layer of aluminium is placed on an electro-deposited layer, which probably is not made up of granules or particles.

In Patent Abstracts of Japan vol. 018, No 538 (M-1686), Oct. 13, 1994 and JP 06 190537A it is disclosed that a wear resistant surface is provided on a cast product, by mixing metal powder and "wafer glass base" to form "raste-state". The resulting mixture is coated on the part of the mould where the wear resistant surface is to be formed on the cast product. After the material is so coated, the molten material is cast into the mould. The result is a "reformed layer on the surface of the casting".

There is no disclosure of the specific extent of coating of the wafer glass base.

In Patent Abstracts of Japan vol. 014 323 (M-0997) Jul. 11, 1990 and No JP 02 108447A it is set forth that a mould core is first of all coated with a mixture of "wafer glass series inorganic binder" and zircon powder. Other coatings are added. When the core has been finally coated, it is fixed in the die and the casting metal material is cast around the core. The core is eventually removed, and the resulting product has a surface characteristic which it would not otherwise have without the surface coating. There is no disclosure of the extent of coating, if any, of function selecting material.

OBJECT AND SUMMARY OF THE INVENTION

It is a first object of the present invention to provide a method of casting a product with a surface having a required function such as wear resistance that is formed easily and inexpensively by means of a normally known pressure casting process.

Further, it is a second object of the present invention to provide a method of casting a product with a function selecting layer of sufficient thickness formed on the surface even when very fine function selecting materials are used, and wherein the machinability of the product as cast is excellent.

According to the invention there is provided a method of casting a product by inserting casting material into a mould cavity, and by which method the product is provided on at least a part of its surface with a layer of intermediate material comprising a function selecting material which has at least one physical property which is different from that of the casting material, and a coating material which is the same as or is from the same group as the casting metal material, and wherein the layer is located in the casting mould cavity prior to inserting the casting metal material into the casting mould cavity and wherein the intermediate material is formed by coating at least half of the function selecting material with the coating material.

Preferably, the function selecting material comprises particles and in one example the function selecting material comprises two different types of function selecting particles.

It is preferred that the intermediate material is granular in nature, and that the layer is provided by a perform of the intermediate material.

In a specific example, the intermediate material comprises at least two types of granular intermediate materials, each of which is formed by coating at least half the surface with the coating metal material.

In another example, the intermediate material is mixed with another function selecting material of at least one physical property which is different from that of the function selecting material of the intermediate material.

When the intermediate material is granular in nature, the granules of the intermediate material preferably have a size in the range 50 $\mu$m to 100 $\mu$m.

According to a specific method, the intermediate material is formed by depositing atomized droplets of a molten metal composition which comprises the function selecting material and the coating metal material onto a collector.

In another specific method, the intermediate material is formed by depositing atomized droplets of a molten metal composition which comprises the function selecting material and the coating metal material onto a collector and the atomized droplets form a semi-molten film in which the solid phase to liquid phase ratio is about 80% and on which surface the solid phase to liquid phase is less than 80%.

Preferably, to locate the intermediate material in the casting mould cavity, the intermediate material is mixed with adhesive and formed as a preset core, which is subsequently located in position in the mould cavity.

Alternatively, to locate the intermediate material in the casting mould cavity, the intermediate material is adhered by adhesive to a surface of a preset core, which is located in position in the mould cavity.

Again, to locate the intermediate material in the casting mould cavity, the intermediate material is adhered in position to the mould cavity by using adhesive to adhere the intermediate material to the surface of the mould cavity.

In any of these cases the adhesive comprises one or more selected from the group consisting of phenolic resin, fran resin, unsaturated polyester resin, urethane resin, polyvinyl acetate resin, polyvinyl chloride resin, inorganic cement, sodium silicate and low melting point metals.

The coating metal material comprises one selected from the group consisting of aluminium, magnesium, zinc, copper, iron and alloys thereof and the function selecting material may comprise one or more selected from the group comprising a primary crystal silicon particle crystallised to a hyper-eutectic Al—Si alloy powder, a carbon particle precipitated to a cast iron powder, SiC, $Al_2O_3$, $Si_3N_4$, $SiO_2$, TiC, graphite, lead, molybdenum disulfide, iron, intermetallic compounds precipitated to aluminium series alloys, $K_2O$—$6TiO_2$, nickel alloys, cobalt alloys, ferrite magnet, magnetic steels, cobalt, pumice, shirasu balloon, alumina balloon, carbon balloon and hollow glass beads.

DETAILED DESCRIPTION OF PREFERRED EMBODIMENTS

In this invention "product" is referred to as a product cast by the pressure casting such as the die cast process, the molten metal forging process, the semi-molten metal forging process or the like. Accordingly, a cast product in the present invention is cast by using a metal material that is normally used in the abovementioned casting processes, that is, metal materials of aluminum, its alloy, magnesium alloy, zinc alloy, copper, its alloy or the like and these metal materials are referred to as "casting metal materials".

Further, although almost all of the cast product in accordance with the present invention is formed by the casting metal material, a layer (hereinafter, function selecting layer) having a required function is formed with a predetermined thickness at only the surface of the product at a necessary portion thereof. The function selecting layer is formed simultaneously with the casting of the cast product.

According to the present invention an intermediate material is formed by a) a material having at least one of physical property value different from that of the casting metal material, that is, a material (hereinafter, function selecting material) having a desired function (physical property) and b) a metal material (hereinafter, coating metal material) for coating the surface of the function selecting material. The intermediate material is cast with the casting material to form the product.

Figure 1:
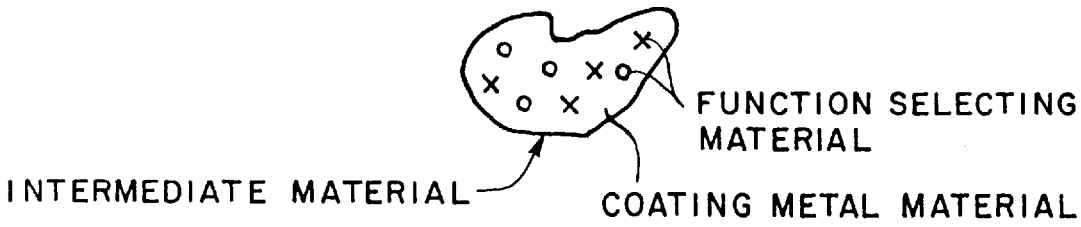
FIGS. 1(*a*), 1(*b*) and 1(*c*) are schematic views for explaining examples of combinations where granular intermediate materials in accordance with the present invention are used.
Figure 1:
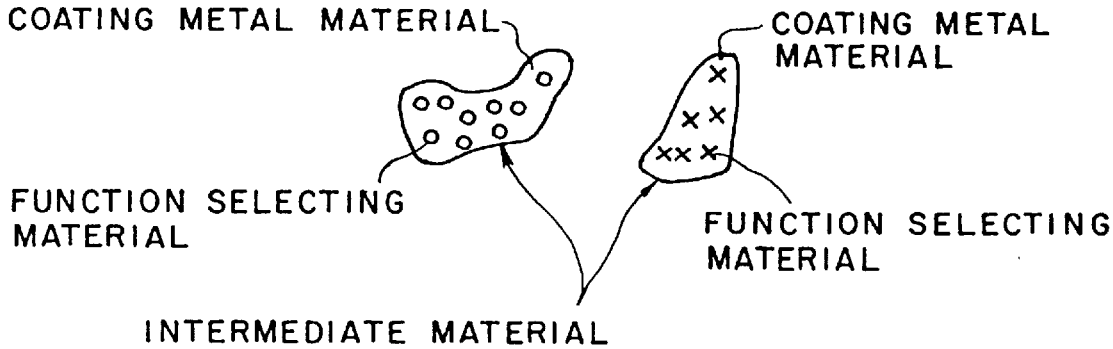
Figure 1:
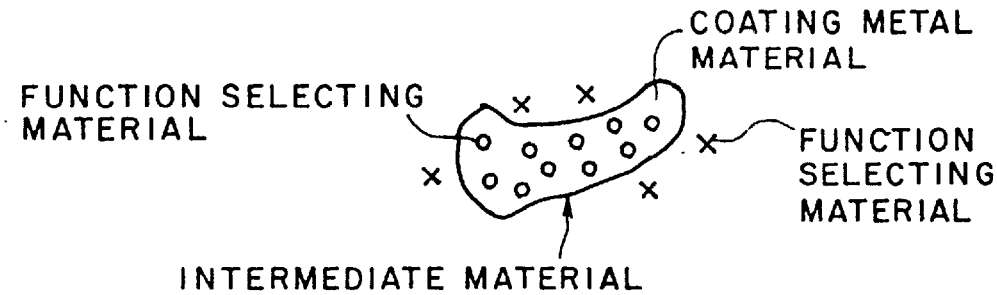

As the particles of the function selecting material are coated with the coating metal material the size of the resulting particles is larger than the size of the function selecting material particles. FIG. 1(*a*) shows the case where one type of function selecting particle is used, and FIG. 1(*b*) shows the case where two kinds of function selecting material particles are used. Alternatively, a granular intermediate material having a large particle size is formed by coating at least a half of the surface of one kind or two kinds or more of the function selecting materials with one kind or two kinds or more of the coating metal materials and the granular intermediate material is used by mixing it with one kind or two kinds or more of function selecting materials having at least one of physical property values different from those of the function selecting materials constituting the granular intermediate material as illustrated in FIG. 1(*c*). Also alternatively, the intermediate material (metal preform material) may be formed on the surface of a collector by atomizing molten metals comprising the function selecting materials and the coating metal material.

The intermediate material formed as illustrated in FIG. 1(*a*) is used when it is easy to uniformly distribute the function selecting material or materials. The intermediate materials formed as illustrated in FIG. 1(*b*) are used when it is difficult to uniformly distribute two kinds or more of the function selecting materials in one intermediate material because the function selecting materials are incompatible with each other, or due to a difference in specific weights thereof, or, in the case where the intermediate material cannot be produced by atomization etc. because the viscosity becomes excessively high as a result of mixing two kinds or more of the function selecting materials. The intermediate material formed as illustrated in FIG. 1(*c*) and is used when it is easy to uniformly distribute the granular intermediate material and one kind or two kinds or more of additional function selecting materials and even if the size of the function selecting material in the intermediate material is small, it can be formed into a thick composite material layer. When a molten metal including the function selecting material and the coating metal material is atomized to form the intermediate material it may be formed on the surface of a collector forming innumerable gaps which the casting metal invades in casting the product.

Atomizing is the technology of converting a molten metal into small droplets (spray) and two types, the pressure injection type atomizing process and gas atomizing process are well known.

The pressure injection type atomizing process is an atomizing process in which molten metal is injected from a vibrating nozzle by applying pressure on the molten metal. In the gas atomizing process molten metal is converted into small droplets (spray) by blowing air or inert gas such as nitrogen gas into the molten metal as it flows downward, and the small droplets are rapidly cooled and solidified as they flow.

According to the present invention these atomizing processes are applied in forming the intermediate material by making the molten metal which has been converted into the small droplets (spray) adhere onto the surface of a collector where they solidify. In the following explanation examples using the gas atomizing process will be disclosed.

In more details, air or inert gas is blown into the molten metal comprising at least one function selecting material and the coating metal material to converting the molten metal into small droplets (spray). The molten metal that has been converted into the small droplets is rapidly cooled and solidified as it flows and the small droplets are made to adhere onto the surface of the collector where they solidify. The collector is formed in a desired shape and the intermediate material preform is created. The comparatively fine droplets derived from the molten metal are made to adhere onto and accumulate on the surface of the collector in a fully solidified state, whilst comparatively large droplets adhere onto and accumulate on the surface of the collector in the molten state. Droplets having an intermediate size adhere onto and accumulate on the surface of the collector in a semi-molten state (state where the liquid phase and the solid phase are mixed) and as a result a semi-molten film is formed on the surface of the collector.

In forming the intermediate material (preform), the temperature and the solid phase ratio are maintained constant by setting the temperature of the molten metal, the pressure of the atomizing gas, the spray distance, the nozzle diameter etc. at pertinent values. It is preferable to set the solid phase to liquid phase ratio of the above mentioned semi-molten film at about 80%. By setting the solid phase ratio of the semi-molten film at about 80%, when the semi-molten film is solidified into the intermediate material (preform), innumerable gaps which the casting metal material can invade in casting the product, are formed and as a result, the adherence of the intermediate material (preform) with respect to the casting metal material is improved and the rigidity of the function selecting layer is improved. When the solid phase ratio of the semi-molten film is less than about 80%, the adherence of the intermediate material (preform) with respect to the casting metal material is not improved. Further, when the solid phase ratio of the semi-molten film is more than about 80%, there are more oversprayed particles which cannot adhere to and accumulate on the surface of the collector and the yield deteriorates.

When it is difficult to obtain a solid phase ratio of about 80%, it is preferable to spray water to droplets adhering to and accumulating on the surface of the collector to promote the solidification.

Gas atomization may be performed by previously mixing the function selecting material into the molten coating metal material and by blowing air or inert gas to the molten material. Alternatively, gas atomization may be performed by blowing air or inert gas including the function selecting material to the molten coating metal material, or by blowing air or inert gas to a molten metal to precipitate crystals of an intermetallic compound.

As for function selecting materials that are applicable to the present invention, there are one or two (selected) selections from the group consisting of primary crystal silicon particle precipitated to hyper-eutectic AlSi alloy powder, carbon particle precipitated to cast iron powder, SiC, $Al_2O_3$, $Si_3N_4$, $SiO_2$, TiC, graphite, lead, molybdenum disulfide, iron, intermetallic compounds precipitated to aluminum series alloys, $K_2O$—$6TiO_2$, nickel alloy, cobalt alloy, ferrite magnet, magnetic steel, cobalt, pumice, shirasu balloon, alumina balloon, carbon balloon, hollow glass beads and the like. The function selecting material is pertinently selected from these in accordance with the desired function to be achieved.

That is, when a cast product is intended to have a layer with the function of, for example, wear resistance, primary crystal silicon particle precipitated to hyper-eutectic Al—Si alloy powder, carbon particle precipitated to cast iron powder, SiC, $Al_2O_3$, $Si_3N_4$, $SiO_2$, TiC, iron, intermetallic compounds precipitated to aluminum series alloys and the like are used as the function selecting materials. When it is intended that the layer should have a function of heat resistance, $K_2O$—$6TiO_2$, $Al_2O_3$, nickel alloy, cobalt alloy and the like are used. When it is intended that the layer should have a function of self lubricity, graphite, lead, BN, molybdenum disulfide and the like are used. When it is intended that the layer should have a function of magnetic property, ferrite magnet, magnetic steel, cobalt and the like are used. When it is intended that the layer should have a function of vibration resistance or sound insulation, pumice, shirasu balloon, alumina balloon, carbon balloon, hollow glass beads and the like are used. When it is intended that the layer should have a chromatic property, Sr2P2O7:Eu(blue purple), BaMg2Al16O27:Eu(blue), MgWO4(blue white), MgGa2O4:Eu(blue green), Zn2SiO4:Eu (green), Y2O3:Eu (red), (Sr, Mg, Ba)3(PO4)2:Sn(orange) and the like are used.

Furthermore, when a plurality of these functions are needed, the function selecting materials of two kinds or more are used.

Although there is no particular restriction to the shape of the particles of these function selecting materials used, it is preferable that the particle size is in a range of 1 $\mu$m to 50 $\mu$m and it is preferable that the size is uniformly and particularly in a range of 1 $\mu$m to 40 $\mu$m when the product as cast is subjected to machining such as cutting. In this case although there is no problem if the size of the function selecting material is small, when the size is 50 $\mu$m or larger, the machinability of the product as cast is reduced which is not preferable.

When primary crystal silicon particle precipitated to hyper-eutectic Al—Si alloy powder is particularly used as the function selecting material, it is preferable that fine primary crystal silicon particles are precipitated by rapidly cooling and solidifying hyper- eutectic Al—Si alloy through atomization and Si component is included by 12 to 50% by weight, more preferably about 20 to 30% by weight.

Further, when carbon particles precipitated to cast iron powder is used as the function selecting material, carbon particles is precipitated by solidifying cast iron.

When intermetallic compounds precipitated to aluminum series alloys are used as the function selecting materials, fine intermetallic compounds are precipitated through atomization by rapidly cooling and solidifying cast metal materials as shown by the following Table 1 and the casting metal materials are selected pertinently in accordance with the required function.

TABLE 1

| Atomized casting metal material and precipitated intermetallic compound | | |
|---|---|---|
| Intermetallic compound | Hardness (Hv) | Casting metal material |
| TiAl | 1200 | Al—Ti—V series alloy |
| FeAl | 500 | Al—Fe series alloy |
| $FeAl_3$ | 500–900 | Al—Fe series alloy |
| $NiAl_3$ | 500–900 | Al—Ni series alloy |
| NiAl | 450 | Al—Ni series alloy |
| $CuAl_2$ | 380 | Al—Cu series alloy |
| $MgAl_3$ | 190 | Al—Mg series alloy |
| CoAl | 400 | Al—Co series alloy |

Further, as the coating metal material used in the present invention, there is a metal material comprising one or two selected from the group consisting of aluminum or its alloy, magnesium alloy, zinc alloy, copper or its alloy, iron or its alloy and the like. A metal material of the same kind or the same group as that of the casting metal material is preferably used. Specifically, when, for example, an aluminum alloy is used as the casting metal material, aluminum or its alloy, magnesium alloy, zinc alloy etc. is used as the coating metal material, or when a magnesium alloy is used as the casting metal material, the magnesium alloy is used also as the coating metal material. In this way, a metal material of the same kind as that of the casting metal material or a metal material which is easy to make an alloy compatible with the casting metal material is used. Thereby, even when the intermediate material is formed in a granular shape and is formed into a metal preform, the intermediate material will not drop off from the surface of the cast product.

When a granular intermediate material is made by coating the surface of particles of a function selecting material with a coating metal material, it is necessary to coat at least a half of the surface of the function selecting material with the coating metal material. Otherwise, the adhering function with respect to the casting metal material is deteriorated and the function selecting material can easily become detached from the cast product.

When a granular intermediate material is prepared, it is prepared by mixing a function selecting material into a molten coating metal material and by crushing it or it is prepared by dispersing it in a liquid phase and by atomizing it or by subjecting the function selecting material and the coating metal material to mechanical alloying.

In this case, it is preferable to form the granular intermediate material into a granular shape having a particle size of about 50 $\mu$m to 1000 $\mu$m. That is, the size (particle size) of the granular intermediate material influences on the density when the granular intermediate material is made to adhere onto the surface of a preset core or the surface of a mold cavity and the density (intervals among particles) significantly influences the thickness of the function selecting layer formed and accordingly, the particle size is pertinently selected in accordance with the required thickness of the reformed layer.

With respect to the preferable dimensions, it was found through experimental results that when the required thickness of the function selecting layer is 1 mm or less, the size (particle size) of the granular intermediate material is rendered 50 $\mu$m or more. When the thickness of the (reformed) function selecting layer is intended to be about 1 mm through 2 mm, the size (particle size) of the granular intermediate layer is 100 $\mu$m or more and when the thickness of the reformed layer is intended to be 2 mm or more, the size (particle size) of the granular intermediate material is 300 $\mu$m or more.

Figure 2:
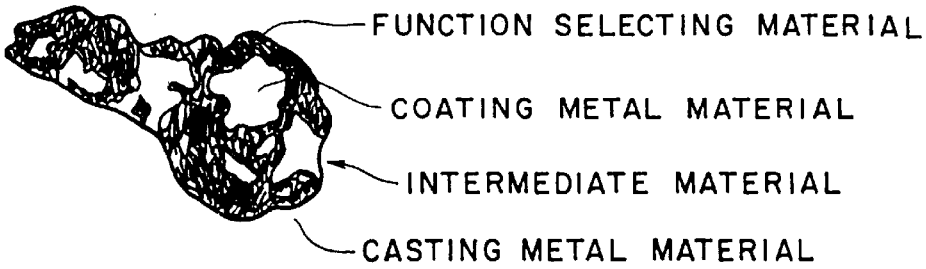
FIG. 2 is a schematic view showing the structure of a granular intermediate material in accordance with the present invention.

With regard to the shape of particle of the granular intermediate material, a polygonal shape having irregularities on the surface is preferable to a spherical shape with smooth surface. When the granular intermediate material is formed of particles in a polygonal shape having irregularities on the surface, the mechanical bonding force bonding the granular intermediate material to the matrix (casting metal material) is improved, whereby the granular intermediate material is prevented from detaching from the cast product. FIG. 2 illustrates a schematic view representing the structure of the granular intermediate material.

As an adhesive agent for forming a preset core by using a granular intermediate material or adhering the granular intermediate material at a predetermined location of the surface of the preset core or a mold cavity, it is preferable that the adhesive agent generates small amounts of gases when it is brought into contact with a molten casting metal material. Specifically, one or at least two selected from the group consisting of phenolic resin, fran resin, unsaturated polyester resin, urethane resin, polyvinyl acetate resin, polyvinyl chloride resin, inorganic cement, sodium silicate, low melting point metals and the like are used.

When a preset core is formed by using a granular intermediate material, conventionally well-known sand core forming processes, for example, the shell core forming process, the cold box core forming process, CO2 core forming process and the like are applicable thereto. Also, a collector as referred to herein may be formed into a desired shape by means of casting, machining, or plastic deformation (deep drawing or impact forming) etc. using a metal material of aluminum, iron etc.

As a preset core for adhering (coating) of a granular intermediate material, well known preset cores of sand cores using sand such as quartz sand, alumina sand, cerabeads, chromite sand etc., a cold box core, a low melting point metal core and the like can be used and in addition thereto, metal cores manufactured by means of casting, machining, plastic deformation (deep drawing, impact forming) etc. using a metal material of aluminum, iron etc., can be used.

Moreover, in order to cast a product with a function selecting layer a preset core formed by adding thereto a granular intermediate material is installed at a predetermined location in a mold cavity, or a granular intermediate material is made to adhere (coated) onto the surface of a previously formed preset core and the preset core is installed at a predetermined location of a mold cavity, or a granular intermediate material is directly made to adhere (coated) onto a portion of a cast product to provide a function, or an intermediate material (preform) formed on the surface of a collector is installed at a predetermined location of a mold cavity by separating it from the collector or without separating it therefrom and thereafter, a molten casting metal material is filled up at the inside of the mold cavity and pressurized at high pressure.

When a granular intermediate material is used with an adhesive agent component at least a portion thereof is decomposed (or molten) into a gaseous state by heat of the casting metal material and further, the casting metal material invades the gas spaces inside of the granular intermediate material to integrate with the granular intermediate material to form a composite body. Thereby, a cast product in which a function selecting material layer is provided is formed. The function selecting layer is of a constant thickness (depth).

Further, when the intermediate material (preform) formed on the surface of a collector through atomization is used, the molten casting metal material is cast together with the intermediate material (preform) to integrate to form a composite body, and when innumerable gaps are formed in the above-mentioned intermediate material (preform), the molten casting metal material invades the inside of the innumerable gaps to thereby form a cast product in which a function selecting layer is formed at the surface over a range of a constant thickness (depth).

EXAMPLES

Next, an explanation will be given of specific examples in which the surface of a cast product is formed to provide wear resistance by the method according to the present invention. However, the present invention is not restricted to such examples but it is to be understood that the function selecting can be conducted by pertinently selecting and using function selecting materials as described above.

Example 1

SiC having a uniformly distributed particle size of around 5 μm was mixed into a molten aluminum alloy (ADCl2) by 10% by weight, dispersed in the liquid phase and converted into a granular intermediate material having a uniformly distributed particle size of 200 (through) to 300 μm through the atomization process. 1200 g of the intermediate material was kneaded by adding a solution in which 500 g of polyvinyl acetate resin was dissolved in 600 g of methanol. The intermediate material was coated on the surface of a previously formed shell core made of zircon sand by a thickness of approximately 4 mm, the preset core was installed at a predetermined location of a mold cavity and a cylinder block was cast by the die-cast process using the aluminum alloy (ADCl2). The casting pressure was set to 50 MPa.

Then, the cast product was taken out from the mold, the preset core was taken out from the cast product and thereafter, the thickness of the resulting function selecting layer (wear resistant layer) formed on the surface of the cast product at a portion thereof where the preset core had been disposed, was measured and the wear resistance test was carried out.

Example 2

A granular intermediate material having a uniformly distributed particle size of around 300 μm in which primary crystal silicon having a uniformly distributed particle size of around 10 μm was precipitated through the atomization process, was prepared by using a molten metal of Al-20% silicon alloy, 300 g of the intermediate material was added with 13 g of phenolic resin and the intermediate material was kneaded for about 1 minute. The intermediate material was adheringly coated on the surface of a preset core made of iron, the preset core was installed at a predetermined location in a mold cavity, the casting was performed as in Example 1 and the thickness and the like of the resulting function selecting layer (wear resistant layer) formed on the surface of the cast product at a portion thereof where the preset core had been disposed, were measured.

Example 3

A granular intermediate material having a uniformly distributed particle size of around 300 μm added with phenolic resin, was adheringly coated on the surface of a preset core made of iron and the casting was performed as in Example 1 except using SiC having a uniformly distributed particle size of around 10 μm, the thickness of the resulting function selecting layer (wear resistant layer) formed on the surface of the cast product at a portion thereof where the preset core had been disposed, was measured and the wear resistance test was carried out.

Example 4

SiC having a uniformly distributed particle size of around 10 μm was mixed in a molten metal of an aluminum alloy (ADCl2) by 10% by weight and dispersed in the liquid phase and a granular intermediate material having a uniformly distributed particle size of around 300 μm was prepared through the atomization process. In addition thereto, graphite having a uniformly distributed particle size of around 150 μm was used as a function selecting material having self lubricity. The same amounts of the granular intermediate material and graphite were mixed and dispersed into a mixture of 300 g, the casting was conducted as in Example 3, the thickness of the resulting function selecting layer (wear resistant layer) formed on the surface of the cast product at a portion thereof where the preset core had been disposed, was measured and the wear resistance test was carried out.

Example 5

The mixture of the granular intermediate material and polyvinyl acetate resin that was prepared in Example 1, was coated on the surface of a portion forming a cylinder in a mold cavity for casting a cylinder block by a thickness of about 1 mm and the cylinder block was cast by the die-cast process. Further, the cast product was taken out from the mold, the thickness of the resulting function selecting layer (wear resistant layer) formed on the surface of the cylinder portion where the mixture had been coated, was measured and the wear resistance test was carried out.

Figure 3:
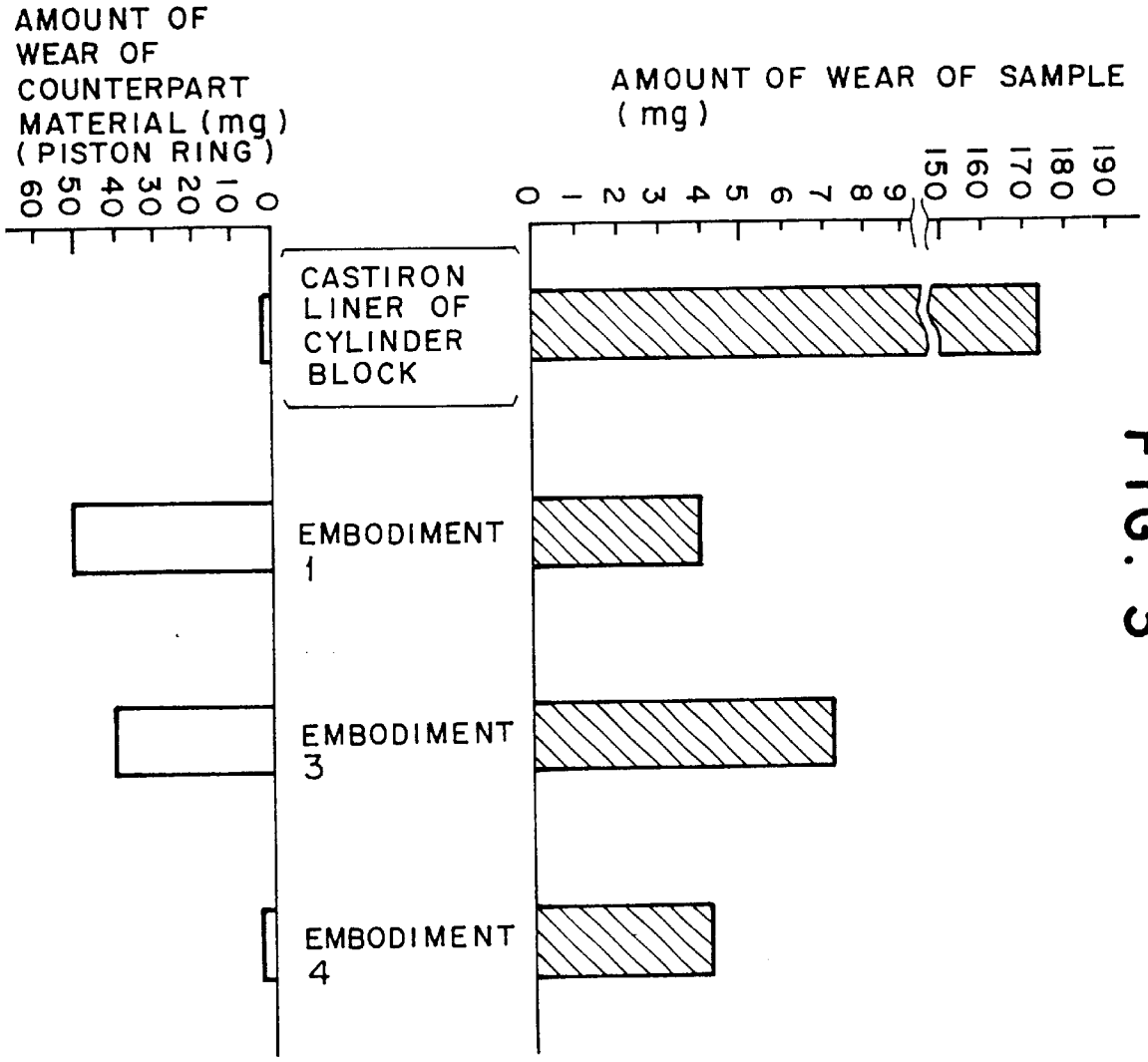
FIG. 3 illustrates a graph showing the test result of the wear resistance of a product that is cast by a method in accordance with the present invention.
Figure 4:
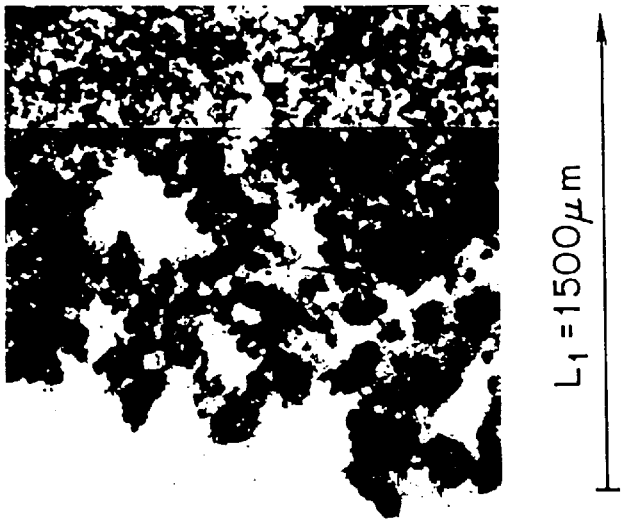
FIG. 4 is a microphotograph showing the metallographic structure of a function selecting layer of a cast product (Example 1) in accordance with the present invention.
Figure 5:
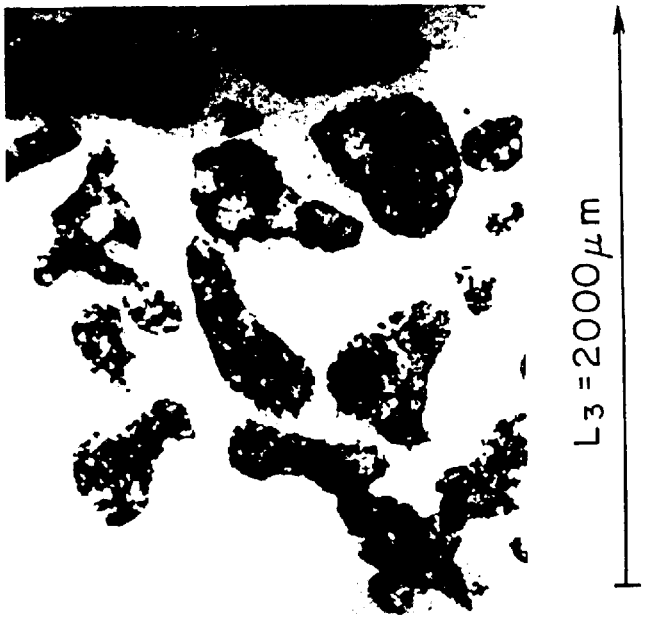
FIG. 5 is a microphotograph showing the metallographic structure of a function selecting layer of a cast product (Example 3) in accordance with the present invention.
Figure 6:
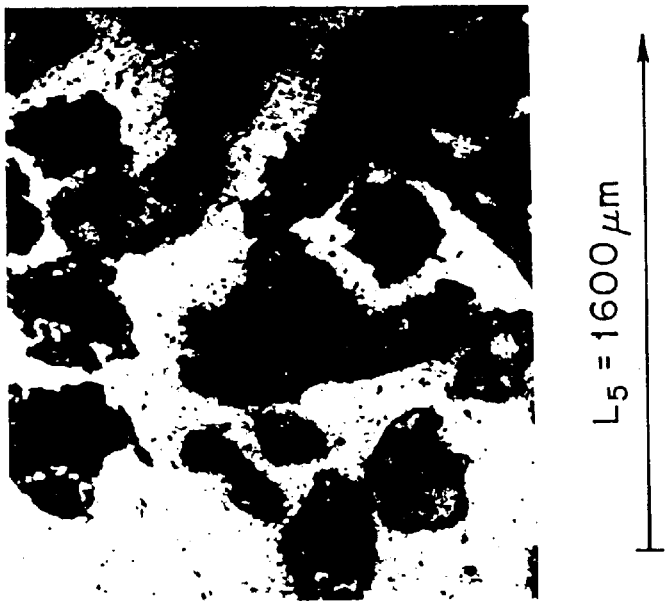
FIG. 6 is a microphotograph showing the metallographic structure of a function selecting layer of a cast product (Example 4) in accordance with the present invention.
Figure 7:
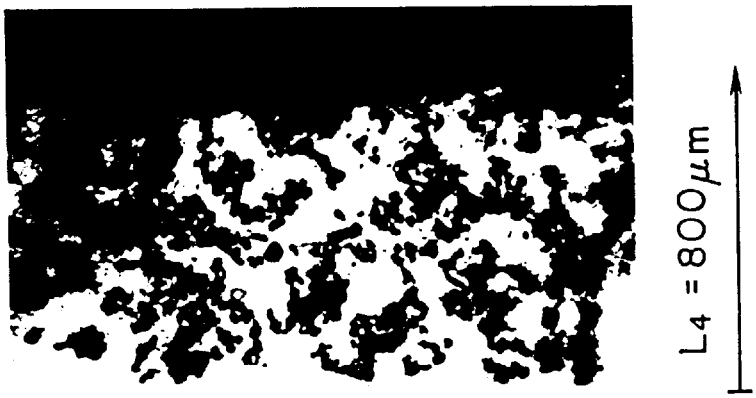
FIG. 7 is a microphotograph showing the metallographic structure of a function selecting layer of a cast product (Example 5) in accordance with the present invention.

The result of test obtained in Examples 1 through 5 is summarized and the hardness (HR B) of the function selecting layer (abrasion resistant layer) formed, the area ratio (%), or a ratio of area of the function selecting material as compared with the total area of the function selecting layer and the thickness (pm) of the function selecting layer are shown in the following Table 2 and the result of the abrasion resistance test is shown in the graph of FIG. 3, respectively.

Incidentally, a comparative example in Table 2 indicates an example of a product which was cast by the normal die-cast process employing the frequently used aluminum alloy (ADCl2). In FIG. 3, a cast iron liner (FC25) is normally used at the cylinder portion of the cylinder block and the liner is brought into abrasive contact with a piston ring (chromium-plated material of 545C) attached to a piston and therefore, the cast iron liner (FC25) was selected as the comparative example and the abovementioned piston ring material was used as a counterpart material in the abrasion resistance test.

TABLE 2

| Example | Example 1 | Example 2 | Example 3 | Example 4 | Example 5 | Comparative Example |
|---|---|---|---|---|---|---|
| Hardness (HR B) | 63 | 65 | 65 | 60 | 67 | 45 |
| Area ratio (%) | 29 | 20 | 19 | 20 | 29 | 0 |
| Thickness (μm) | 1500 | 2000 | 2000 | 1600 | 800 | — |

It is understood from the above Table 2 and FIG. 3 that the abrasion resistance of the function selecting layer of the present invention is significantly improved. Furthermore, according to FIG. 3, although considerably excellent abrasion resistance is shown in Example 1 and Example 3 as compared with the cast iron liner material of the comparative example, the counterpart materials are flawed. However, according to Example 4, not only the wear resistance is excellent but the counter material is not flawed as a result of achieving the function (self lubricity) provided to the function selecting material (graphite) whereby two kinds or more of functions are realized.

FIG. 4 through FIG. 7 show microphotographs of the metallographic structures of the function selecting layers (abrasion resistant layers) formed on the surfaces of the cast products in Examples 1 and 3 through 5. In these microphotographs, the black portion designates function selecting materials (SiC or graphite), the gray or whitish portion designates the coating metal material that is integrated to the casting metal to form a composite body and a portion which looks white as a whole designates the casting metal material (aluminum alloy: ADCl2). Notations L1, L2, L3 and L4 designate the thicknesses of the function selecting layers (abrasion resistant layers).

It is understood by observing the metallographic structures shown in these microphotographs that the function selecting material, the coating metal material and the casting metal material are integrated to form a composite body and the function selecting layer is formed with a thickness of 500 μm through 2000 μm or more.

As described above, according to the method of forming a surface of a cast product in accordance with the present invention, the surface of the necessary portion of the cast product can be added with the required function such as the abrasion resistance etc. and therefore, it can be formed only by casting the product by means of the high pressure casting process. Accordingly, the surface of a cast product can be reformed easily and inexpensively.

Furthermore, a layer in which the function selecting material, the coating metal material and the casting metal material are integrated to form a composite body, can easily be formed on the surface of the necessary portion of the cast product with a practically sufficient thickness (500 μm through 4000 μm or more) even by using particles of the function selecting material having a small magnitude (for example, about 1 μm through 10 pm). Incidentally, the practical thickness thereof is 300 μm through 500 μm in the case where machining is not necessary for the product as cast and it is 1000 μm or more in the case where a machining depth is necessary. Therefore, according to the method of forming a surface of a cast product in accordance with the present invention, the finishing depth can be provided in accordance with the necessity and the dimensional accuracy of the function selecting layer portion.

Also, a very fine function selecting material can be used and therefore, the machinability is excellent in the case where machining such as cutting is necessary for the product as cast whereby the productivity can be promoted.

Furthermore, in addition to the advantage that the very fine function selecting material can be used, a plurality of function selecting materials can be used by pertinently selecting the function selecting materials whereby a surface that is provided with a plurality of functions can easily be carried out.

When an intermediate material (preform) is formed on the surface of a collector by atomizing a molten metal comprising the function selecting material and the coating metal material and a function selecting layer is formed by casting together with the intermediate material (preform), the function selecting material is almost completely integrated with the casting metal material forming the cast product to form a composite body and therefore, there is no risk of the function selecting material becoming detached, and the strength of the reformed layer can be promoted. Also, there is no concern that the function of the cast material will deteriorate afterwards since there exists no foreign substance other than the casting metal material and the function selecting material at the inside of the function selecting layer.

In addition thereto, in the case where the function selecting material that is incorporated in the casting metal material by the casting operation, is adhered to the surface of a collector and solidified there along with the coating metal material by atomization, innumerable gaps are formed in the intermediate material (preform) that is formed on the surface of the collector by setting atomizing conditions such as the temperature of molten metal, the nozzle diameter etc. at pertinent values. During casting, the casting metal material invades the inside of the gaps, improving the adherence of the intermediate material (preform) with respect to the casting metal material and the rigidity of the reformed layer can be promoted.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

What is claimed is:

1. A method of casting a product, said method comprising the steps of:

inserting casting material into a mould cavity in such a manner that the product is provided on at least a part of its surface with a layer of intermediate material, said intermediate material has a function selecting material with at least one physical property that is different from the casting material, said product including a pre-formed component and a component cast in the mould cavity with said intermediate material, and providing a coating material which is the same as or is from the same group as the casting metal material, and wherein the layer of intermediate material is located in the casting mould cavity and is disposed away from said pre-formed component prior to inserting the casting metal material into the casting mould cavity, and wherein the intermediate material is formed by coating at least half of the function selecting material with the coating material.

2. A method according to claim 1, wherein the function selecting material comprises particles.

3. A method according to claim 1, wherein the function selecting material comprises two different types of function selecting particles.

4. A method according to claim 1, wherein the intermediate material is granular in nature.

5. A method according to claim 1, wherein the layer is provided by a perform of the intermediate material.

6. A method according to claim 1, wherein the intermediate material comprises at least two types of granular intermediate materials, at least half of each granular intermediate material is coated with the coating metal material.

7. A method according to claim 1, wherein the intermediate material is mixed with another function selecting material of at least one physical property which is different from that of the function selecting material of the intermediate material.

8. A method according to claim 1, wherein the granules of the intermediate material have a size in the range 50 $\mu$m to 100 $\mu$m.

9. A method according to claim 1, wherein the intermediate material is formed by depositing atomized droplets of a molten metal composition which comprises the function selecting material and the coating metal material onto a collector.

10. A method according to claim 1, wherein the intermediate material is formed by depositing atomized droplets of a molten metal composition which comprises the function selecting material and the coating metal material onto the collector and is formed to have innumerable gaps therein, which the casting metal material can invade.

11. A method according to claim 1, wherein the intermediate material is formed by depositing atomized droplets of molten metal composition which comprises the function selecting material and the coating metal material onto a collector and the atomized droplets form a semi-molten film in which the solid phase to liquid phase ratio is about 80% and on which surface the solid phase to liquid phase is less than 80%.

12. A method according to claim 1, wherein to locate the intermediate material in the casting mould cavity, the intermediate material is mixed with adhesive and formed as a preset core, which is subsequently located in position in the mould cavity.

13. A method according to claim 12, wherein the adhesive comprises one or more selected from the group consisting of phenolic resin, fran resin, unsaturated polyester resin, urethane resin, polyvinyl acetate resin, polyvinyl chloride resin, inorganic cement, sodium silicate and low melting point metals.

14. A method according to claim 1, wherein to locate the intermediate material in the casting mould cavity, the intermediate material is adhered by adhesive to a surface of a preset core, which is located in position in the mould cavity.

15. A method according to claim 1, wherein to locate the intermediate material in the casting mould cavity, the intermediate material is adhered in position to the mould cavity by using adhesive to adhere to intermediate material to the surface of the mould cavity.

16. A method according to claim 1, wherein the coating metal material comprises one selected from the group consisting of aluminum, magnesium, zinc, copper, iron and alloys thereof.

17. A method according to claim 1, wherein the function selecting material comprises one or more selected from the group comprising a primary crystal silicon particle crystallised to a hyper-eutectic Al-Si alloy powder, a carbon particle precipitated to a cast iron powder, SiC, $Al_2O_3$, $Si_3N_4$, $SiO_2$, TiC, graphite, lead, molybdenum disulfide, iron, intermetallic compounds precipitated to aluminum series alloys, $K_2O$—$6TiO_2$, nickel alloys, cobalt alloys, ferrite magnet, magnetic steels, cobalt, pumice, shirasu balloon, alumina balloon, carbon balloon and hollow glass beads.

18. A method of casting a product, comprising the steps of:

providing a layer of intermediate material into a casting mould cavity;

providing a coating material into said casting mould cavity;

providing casting material into said casting mould cavity in such a manner that said casting material is provided on at least a part of its surface with said layer of intermediate material, said product including a pre-formed component and a component cast in the mould cavity with said intermediate material, and said intermediate material being disposed away from said pre-formed component of said product;

a portion of said intermediate material is comprised of a function selecting material with at least one physical property that is different from said casting material; and said coating material is from the same group as said casting material;

wherein said intermediate material is formed by coating at least half of said function selecting material with said coating material.

* * * * *